US010955797B2

(12) United States Patent
Takahashi et al.

(10) Patent No.: US 10,955,797 B2
(45) Date of Patent: Mar. 23, 2021

(54) ATTACHMENT AND DETACHMENT STRUCTURE OF TONER CONTAINER AND IMAGE FORMING APPARATUS

(71) Applicant: KYOCERA Document Solutions Inc., Osaka (JP)

(72) Inventors: Satoru Takahashi, Osaka (JP); Keisuke Mizuguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/933,882

(22) Filed: Jul. 20, 2020

(65) Prior Publication Data

US 2021/0026296 A1 Jan. 28, 2021

(30) Foreign Application Priority Data

Jul. 22, 2019 (JP) ..... JP2019-134816

(51) Int. Cl.
*G03G 21/16* (2006.01)
*G03G 21/18* (2006.01)
*G03G 15/08* (2006.01)

(52) U.S. Cl.
CPC ..... *G03G 21/1864* (2013.01); *G03G 15/0875* (2013.01); *G03G 15/0889* (2013.01); *G03G 21/1647* (2013.01); *G03G 21/1857* (2013.01); *G03G 2215/0665* (2013.01); *G03G 2215/0827* (2013.01); *G03G 2221/1657* (2013.01)

(58) Field of Classification Search
CPC ..... G03G 15/0875; G03G 15/0889; G03G 21/1647; G03G 21/1857; G03G 21/186; G03G 21/1864; G03G 2215/0665; G03G 2221/1657
See application file for complete search history.

(56) References Cited

U.S. PATENT DOCUMENTS

2015/0086242 A1* 3/2015 Tsuchiya ..... G03G 15/0865 399/258
2015/0185691 A1* 7/2015 Itabashi ..... G03G 15/0865 399/263

FOREIGN PATENT DOCUMENTS

JP 2013-037310 A 2/2013

* cited by examiner

*Primary Examiner* — Hoang X Ngo
(74) *Attorney, Agent, or Firm* — Studebaker & Brackett PC

(57) ABSTRACT

An attachment and detachment structure attaches and detaches a toner container to and from an attachment unit. The toner container includes a container main body, a rotational member and a power transmission body. The rotational member rotates around an axis to agitate the toner contained in the container main body. The power transmission body is provided outside the container main body and rotates around an axis to transmit a rotational force to the rotational member. The attachment unit includes a contact body which comes into contact with the power transmission body on attachment process and detachment process of the toner container to and from the attachment unit and rotates the power transmission body. The power transmission body comes into contact with the contact body on the attachment process of the toner container to the attachment unit, and is rotated around the axis to rotate the rotational member around the axis.

8 Claims, 8 Drawing Sheets

ATTACHMENT AND DETACHMENT STRUCTURE OF TONER CONTAINER AND IMAGE FORMING APPARATUS

INCORPORATION BY REFERENCE

This application is based on and claims the benefit of priority from Japanese Patent application No. 2019-134816 filed on Jul. 22, 2019, which is incorporated by reference in its entirety.

TECHNICAL FIELD

The present disclosure relates to an attachment and detachment structure of a toner container and an image forming apparatus.

BACKGROUND

A toner bottle may be provided with a powder loosening means which applies external force to a toner to loosen the toner when it is attached to a tonner replenishment device. The toner loosening means is formed by a flexible member provided near a discharge port of a toner discharge path. With the attachment operation of the toner bottle, the flexible member is deformed to loosen the toner near the discharge port.

The above toner bottle has a problem in which its strength is decreased because a part of the toner discharge path is formed by the flexible member.

SUMMARY OF THE INVENTION

In accordance with one aspect of the present disclosure, an attachment and detachment structure attaches and detaches a toner container to and from an attachment unit. The toner container includes a container main body, a rotational member and a power transmission body. The container main body contains a toner. The rotational member rotates around an axis to agitate the toner contained in the container main body. The power transmission body is provided outside the container main body and rotates around an axis to transmit a rotational force to the rotational member. The attachment unit includes a contact body which comes into contact with the power transmission body on attachment process and detachment process of the toner container to and from the attachment unit and rotates the power transmission body. The power transmission body comes into contact with the contact body on the attachment process of the toner container to the attachment unit, and is rotated around the axis to rotate the rotational member around the axis.

In accordance with one aspect of the present disclosure, an image forming apparatus includes the attachment and detachment structure of the toner container to and from the attachment unit, and an image forming part which forms an image using the toner contained in the toner container.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, the embodiment of the present disclosure will be described. "Fr", "Rr", "L", "R", "U" and "D" marked in each figure respectively show "front", "rear", "left", "right", "upper" and "lower". In the specification, although terms showing direction and position are used, these terms are used for convenience of description, and do not limit the technical scope of the present disclosure.

Figure 1:
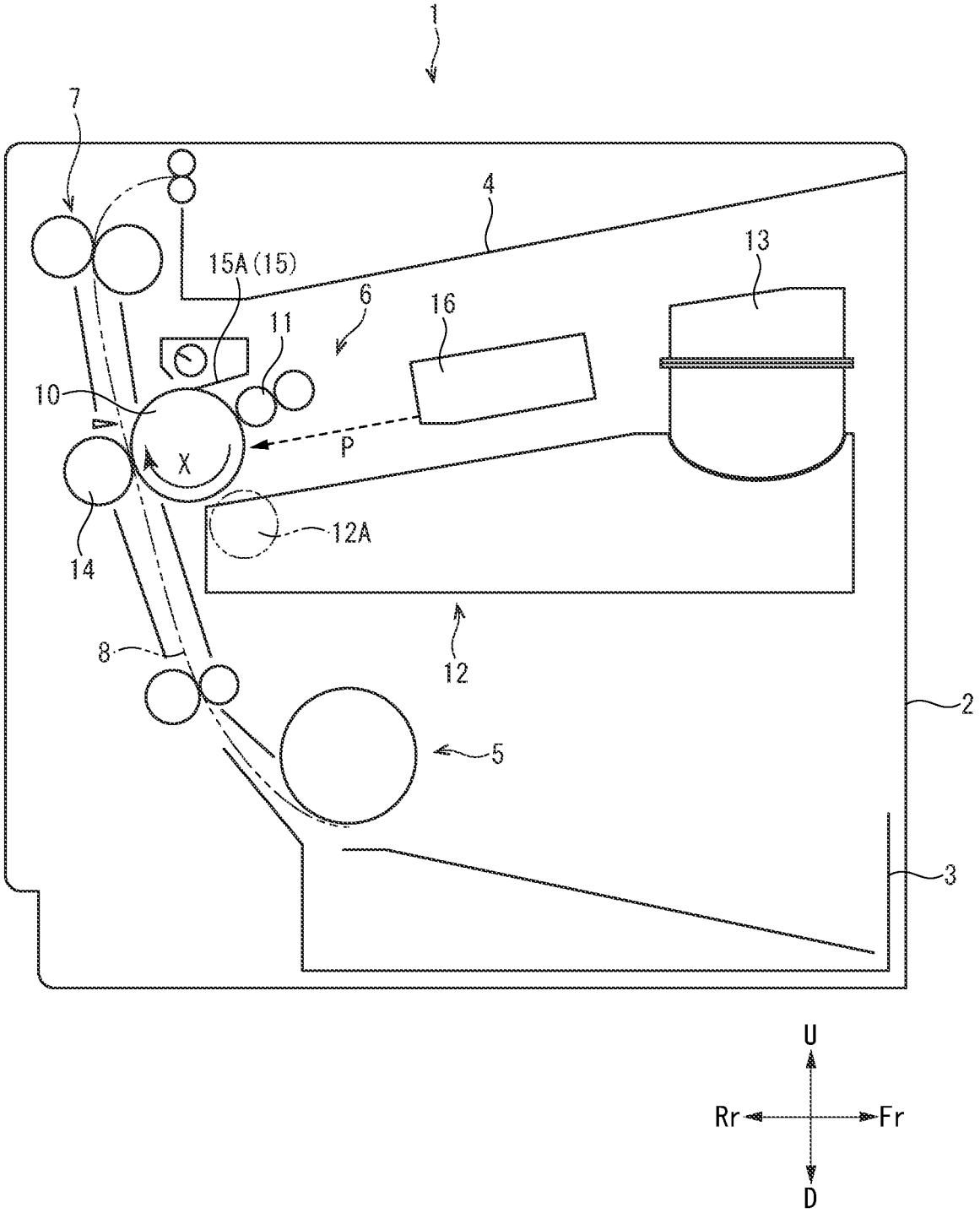
FIG. 1 is a view (a side view) schematically showing an inner structure of a printer according to one embodiment of the present invention.

[Outline of printer] With reference to FIG. 1, a printer 1 as an example of an image forming apparatus will be described. FIG. 1 is a view (a side view) schematically showing an inner structure of the printer 1.

The printer 1 includes an apparatus main body 2 constituting an approximately parallelepiped outer appearance. In the lower portion of the apparatus main body 2, a sheet feeding cassette 3 storing a paper sheet is detachably provided. On the upper face of the apparatus main body 2, a discharge tray 4 is provided. The sheet S is not limited to the paper sheet, but may be a resin sheet or the others.

The printer 1 includes a sheet feeding device 5, an image forming unit 6 and a fixing device 7 which are provided in the apparatus main body 2. The sheet feeding device 5 is provided at the upstream end portion of a conveyance path 8 extending from the sheet feeding cassette 3 to the discharge tray 4. The fixing device 7 is provided on the downstream portion the conveyance path 8, and the image forming unit 6 is provided on the conveyance path 8 between the sheet feeding device 5 and the fixing device 7.

The image forming unit 6 includes a photosensitive drum 10, a charging device 11, a development device 12, a toner container 13, a transferring roller 14, a cleaning device 15 and an optical scanning unit 16. The charging device 11, the development device 12, the transferring roller 14 and the cleaning device 15 are disposed around the photosensitive drum 10 in a transferring process (refer to the arrow X).

The photosensitive drum 10 is formed into a cylindrical shape long in the left-and-right direction, and coupled with a drive motor (not shown) via a gear train. The charging device 11 has a charging roller (not shown) which rotates around an axis while coming into contact with the photosensitive drum 10 to charge the surface of the photosensitive drum 10 (a contact charging type).

The development device 12 has a development roller 12A (not shown) facing the photosensitive drum 10 with an interval. The development roller 12A is applied with development vias from a power source (not shown), and supplies a toner on the photosensitive drum 10 while rotating around an axis. The toner container 13 is detachably attached to the front portion of the upper face of the development device 12. The toner container 13 contains the black toner, for example, and the toner is replenished from the toner container 13 to the development device 12. The toner may be a two-component developer containing the toner and a carrier or a one-component developer containing a magnetic toner.

The transferring roller 14 comes into pressure-contact with the photosensitive drum 10 with predetermined pressure, and presses the sheet conveyed along the conveyance path 8 on the photosensitive drum 10. The cleaning device 15 brings a blade 15A contact with the surface of the photosensitive drum 10 to remove the toner remaining on the surface of the photosensitive drum 10.

The optical scanning unit 16 emits scanning light on the photosensitive drum 10, and forms an electrostatic latent image on the surface of the charged photosensitive drum 10.

[Image forming processing] An operation of the printer 1 will be described. A controller (not shown) of the printer 1 controls each device suitably to perform an image forming processing as follows. The charging device 11 charges the surface of the photosensitive drum 10 at a predetermined potential. The photosensitive drum 10 receives the scanning light (refer to the arrow P in FIG. 1) emitted from the optical scanning unit 16 and carries the electrostatic latent image. The development device 12 develops the electrostatic latent image carried on the photosensitive drum 10 into a toner image by using the toner supplied from the toner container 13. The sheet is fed by the sheet feeding device 5 from the sheet feeding cassette 3 to the conveyance path 8. The transferring roller 14 transfers the toner image on the photosensitive drum 10 to the sheet passing between the transferring roller 14 and the photosensitive drum 10. The fixing device 7 fixes the toner image to the sheet using heat. Then, the sheet is discharged on the discharge tray 4. The cleaning device 15 removes the toner remaining on the photosensitive drum 10.

Figure 2:
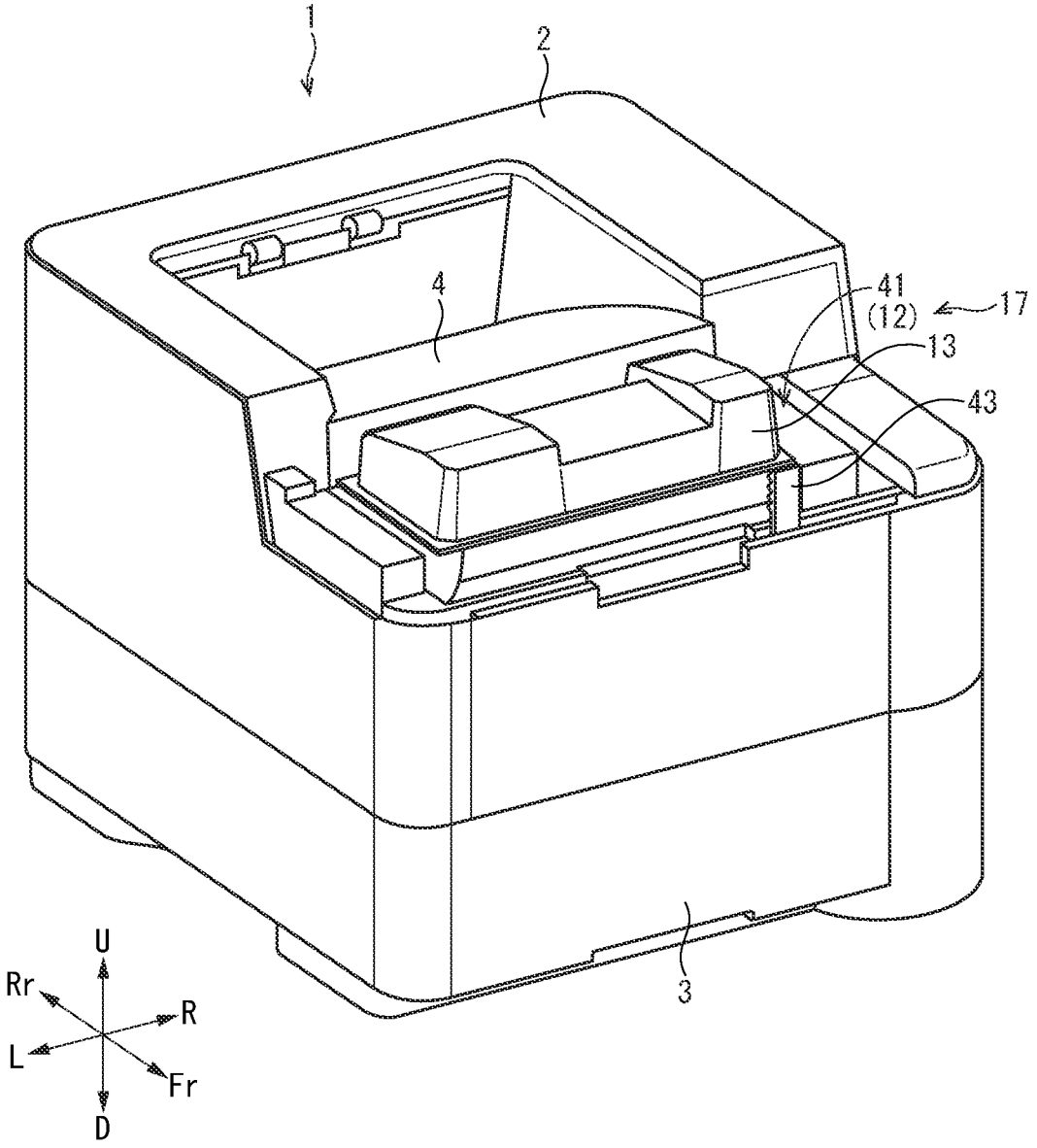
FIG. 2 is a perspective view showing the printer according to the embodiment of the present invention.
Figure 3:
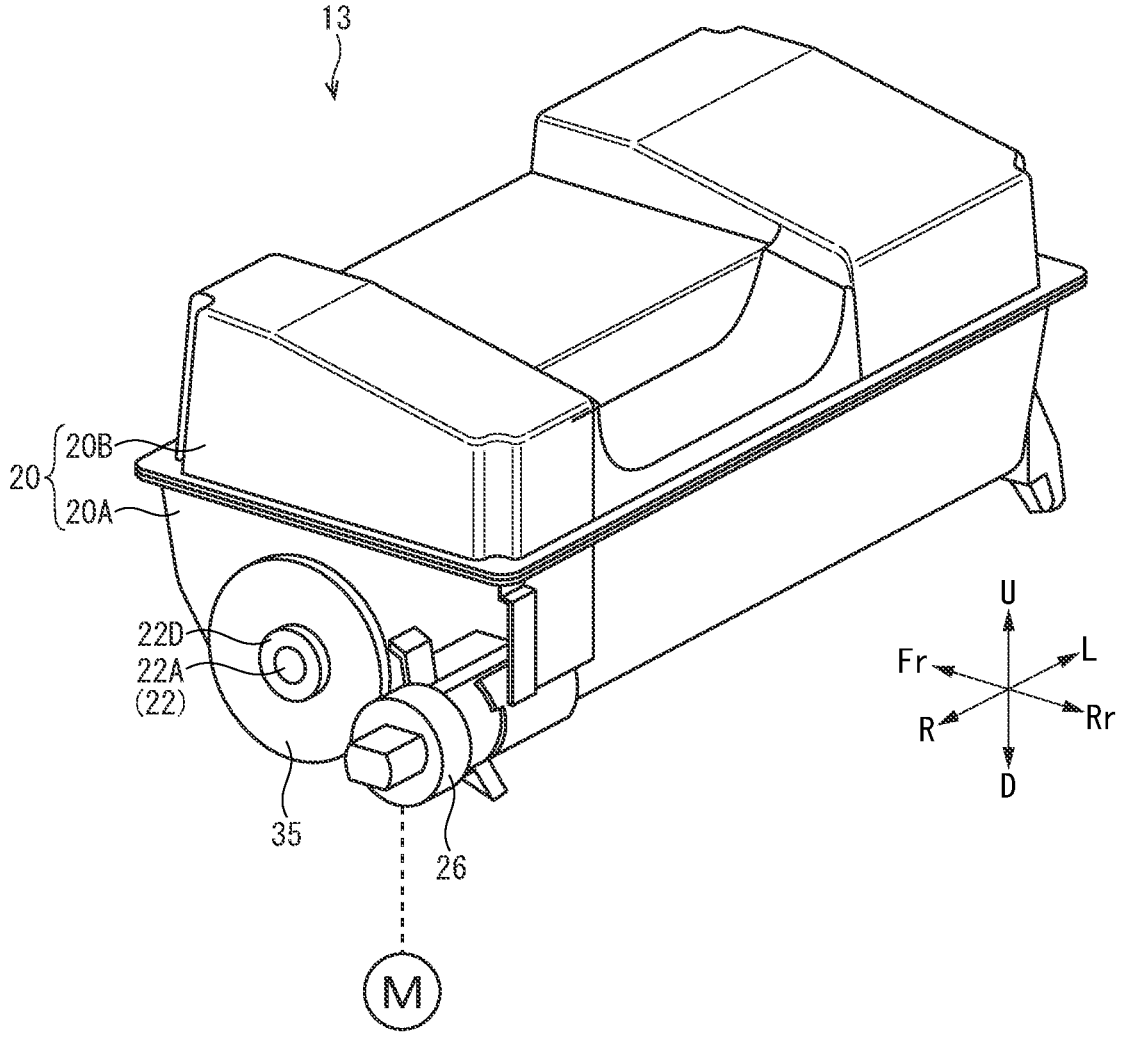
FIG. 3 is a perspective view showing a toner container according to the embodiment of the present invention.
Figure 4:
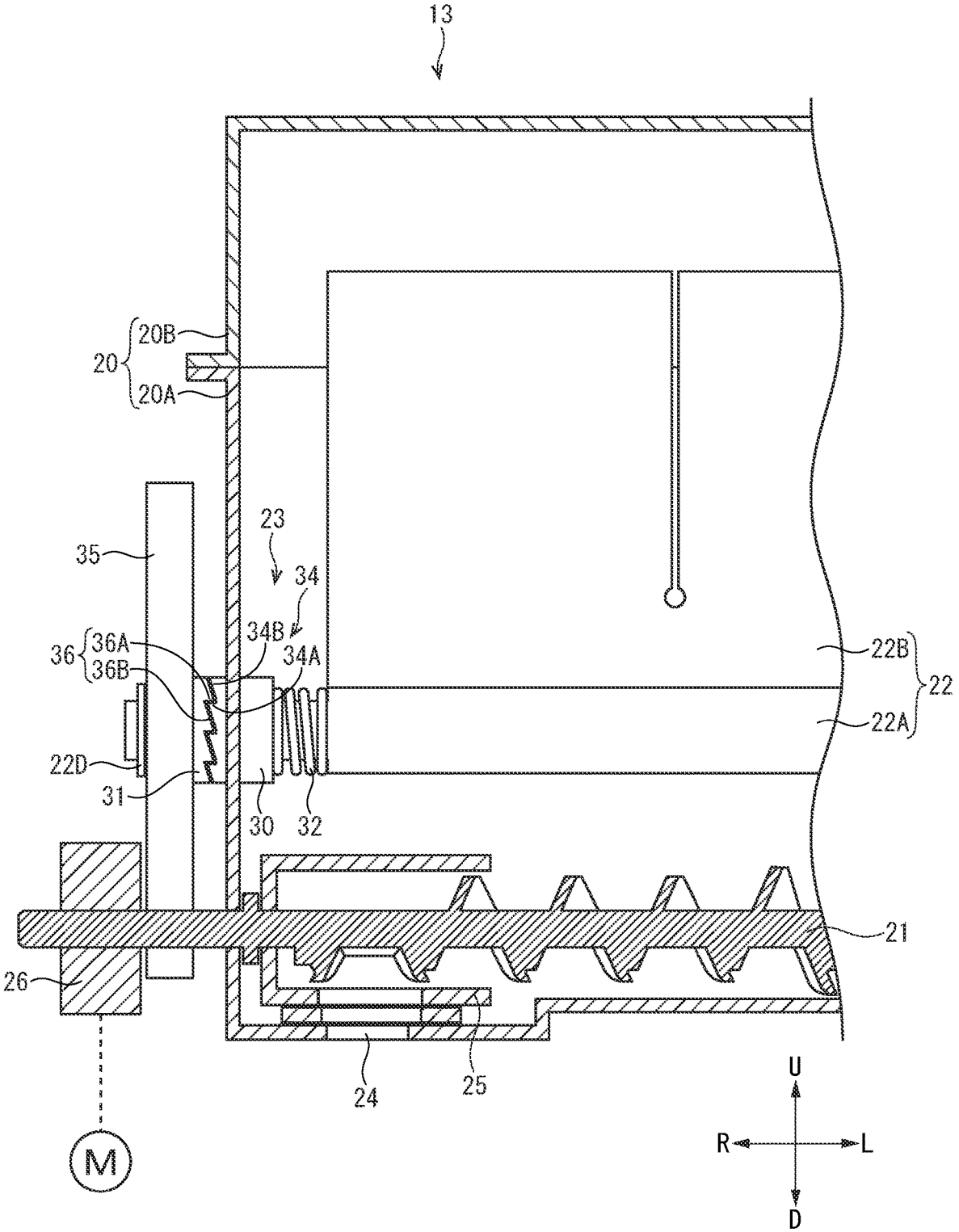
FIG. 4 is a sectional view showing a conveyance screw and the others, in the toner container according to the embodiment of the present disclosure.
Figure 5:
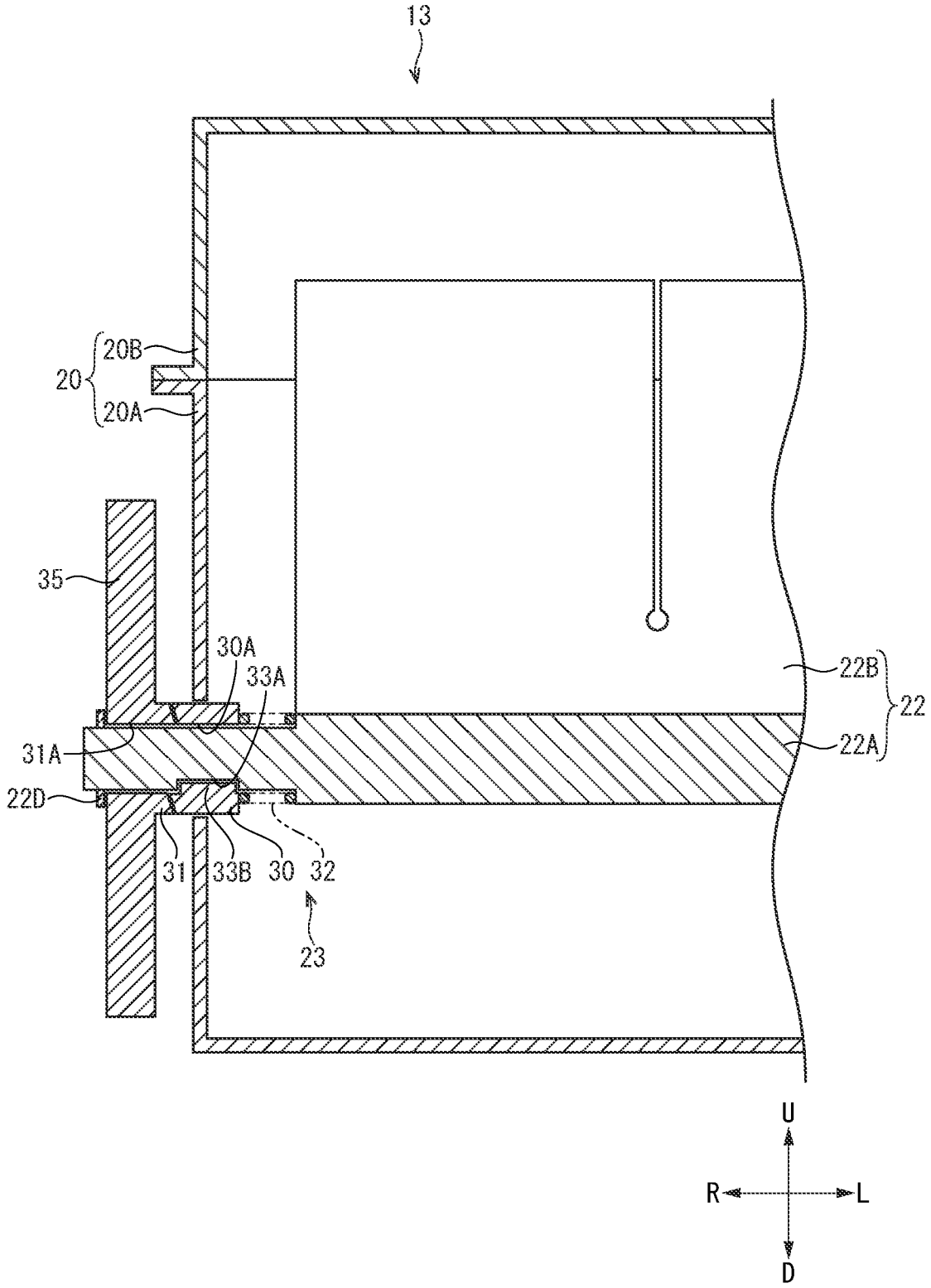
FIG. 5 is a sectional view showing a ratchet mechanism and the others, in the toner container according to the embodiment of the present disclosure.
Figure 6:
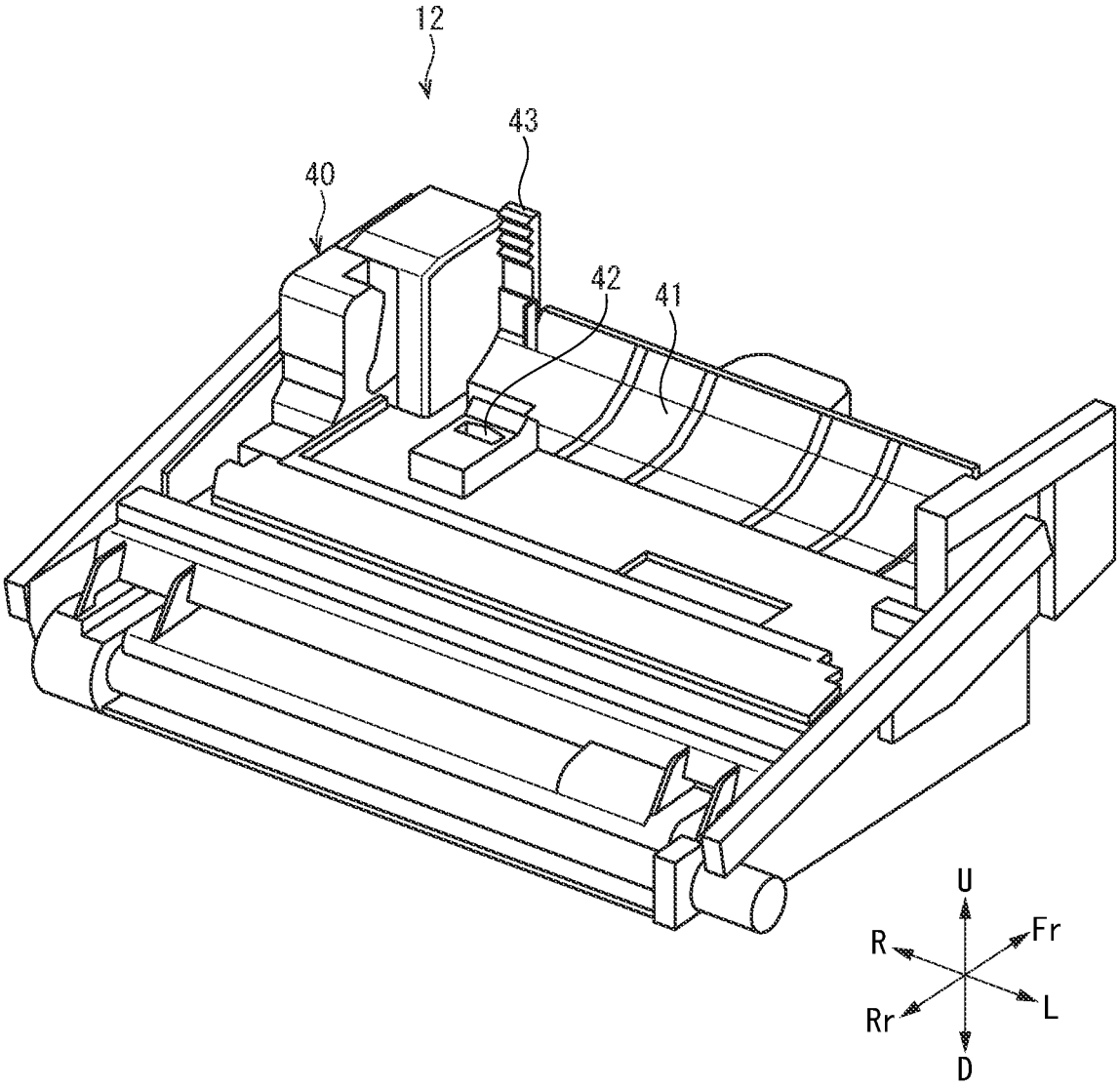
FIG. 6 is a perspective view showing a development device according to the embodiment of the present disclosure.

[Attachment and detachment structure of toner container] Next, with reference to FIG. 2 to FIG. 6, an attachment and detachment structure 17 of the toner container 13 will be described. FIG. 2 is a perspective view showing the printer 1. FIG. 3 is a perspective view showing the toner container 13. FIG. 4 is a sectional view showing a conveyance screw 21 and the others of the toner container 13. FIG. 5 is a sectional view showing a ratchet mechanism 23 and the others of the toner container 13. FIG. 6 is a perspective view showing the development device 12.

As shown in FIG. 2, the apparatus main body 2 (the discharge tray 4) is configured such that an upper front side exterior cover (not shown) can be detached. In the upper front side portion of the apparatus main body 2, the attachment and detachment structure 17 of the toner container 13 is provided, and when the upper front side exterior cover is detached, the toner container 13 is exposed. This makes it possible to replace the toner container 13.

The attachment and detachment structure 17 includes the toner container 13 and the development device 12.

<Toner container> As shown in FIG. 3 and FIG. 4, the toner container 13 includes a container main body 20, a conveyance screw 21, an agitation member 22 (a rotational member) and a ratchet mechanism 23 (a coupling part).

(Container main body) The container main body 20 is made of synthetic resin, for example, and formed into an approximately parallelepiped shape (a hollow box-like shape) long in the left-and-right direction. The container main body 20 has a storage part 20A formed into a box-like shape whose upper face is opened, and a lid part 20B closing the upper opened face of the storage part 20A. The container main body 20 contains the toner.

The right rear portion of the container main body (the storage part 20A) is formed into an approximately cylindrical shape, and on the lower face of the cylindrical right rear portion, a discharge port 24 through which the toner is discharged is formed. In the cylindrical right rear portion, an approximately cylindrical shutter 25 is provided so as to be rotatable around an axis. The shutter 25 is rotated in one direction to open the discharge port 24 while it is rotated in the other direction to close the discharge port 24. The shutter 25 is operated using a lever by a user (operator) (the operation is not described).

(Conveyance screw) As shown in FIG. 4, the conveyance screw 21 is disposed in the rear side portion of the inside of the container main body 20 (the storage part 20A). The conveyance screw 21 is made of synthetic resin, for example, and formed into an approximately rod-like shape long in the left and-right direction. The conveyance screw 21 is one that a spiral blade is fixed around an outer circumferential face of a screw shaft. The conveyance screw 21 (the screw shaft) is rotatably supported by the left and right side walls of the container main body 20. The screw shaft of the conveyance screw 21 penetrates the right side wall of the container main body 20 and protrudes rightward. To the right end portion of the screw shaft, a driving gear 26 (a spur gear) is fixed. The conveyance screw 21 is driven to be rotated around an axis, and has a function to convey the toner contained in the container main body 20 rightward (to a side of the discharge port 24).

(Agitation member) As shown in FIG. 3 and FIG. 4, the agitation member 22 as an example of the rotational member is disposed in front of the conveyance screw 21 in the container main body 20 (the storage part 20A). As shown in FIG. 4, the agitation member 22 has an agitation shaft 22A and an agitation blade 22B.

The agitation shaft 22A is made of synthetic resin, for example, and formed into an approximately rod-like shape long in the left-and-right direction. Both the left and right end portions of the agitation shaft 22A are each formed into an approximately rod-like shape thinner than the center portion, and are rotatably supported by the left and right side walls of the storage part 20A. In detail, the right end portion of the agitation shaft 22A is supported by the right side wall of the storage part 20A via the ratchet structure 23 described later. The right end portion of the agitation shaft 22A penetrates the right side wall of the storage part 20A and protrudes rightward. To the right end portion of the agitation shaft 22A protruding outside the container main body 20 (the storage part 20A), an agitation gear 35 (a power transmission body) is provided. The agitation blade 22B is a film made of synthetic resin, for example, and formed into an approximately rectangular shape. The base end portion of the agitation blade 22B is fixed to the agitation shaft 22A, and the agitation blade 22B extends outwardly in the radial direction from the agitation shaft 22A. The agitation blade 22B has a plurality of slits from its tip edge toward the base end. The agitation member 22 is rotated around an axis and has a function to agitate the toner contained in the container main body 20.

(Ratchet mechanism) As shown in FIG. 4 and FIG. 5, the ratchet mechanism 23 as an example of a coupling part is disposed between the agitation member 22 and the agitation gear 35. In detail, the agitation gear 35 is formed integrally with the member of the ratchet mechanism 23. The ratchet mechanism 23 includes a first cylindrical member 30, a second cylindrical member 31 and a pressing spring 32.

(First cylindrical member) The first cylindrical member 30 is made of synthetic resin or metal, for example, and formed into an approximately cylindrical shape. The first cylindrical member 30 is provided so as to cover the circumferential face of the right end portion of the agitation shaft 22A, and rotatably supported by the right side wall of the container main body 20. The first cylindrical member 30 has a first through hole 30A through which the right end portion of the agitation shaft 22A is passed (refer to FIG. 5). In the base end portion of the right end portion of the agitation shaft 22A (on a side of the step part 22C), a key groove 33A is formed while a key 33B engaged with the key groove 33A is formed on the inner circumferential face of the first through hole 30A (refer to FIG. 5). The key 33B may be formed on the right end portion of the agitation shaft 22A while the key groove 33A may be formed on the inner circumferential face of the first through hole 30A.

On the right end face (a face facing the second cylindrical member 31) of the first cylindrical member 30, a plurality of first claw parts 34 is provided side by side in the rotational direction. Each first claw part 34 is a projection inclined in one direction of the rotational direction, and has an upright face 34A parallel to the axial direction on one side of the rotational direction and an inclined face 34B crossing to the axial direction on the other side of the rotational direction (refer to FIG. 4).

(Second cylindrical member) The second cylindrical member 31 is made of synthetic resin or metal, for example, and formed into an approximately cylindrical shape. The second cylindrical member 31 is provided so as to cover the circumferential face of the right end portion of the agitation shaft 22A protruding outside the container main body 20, and disposed on a right side of the first cylindrical member 30. The second cylindrical member 31 has a second through hole 31A through which the right end portion of the agitation shaft 22A is passed (refer to FIG. 5). The second through hole 31A has an inner diameter allowing the rotation of the right side portion of the agitation shaft 22A. Accordingly, the second through hole 31A does not have the key 33B while the right end portion of the agitation shaft 22A passing through the second through hole 31A does not have the key groove 33A. Around the right end portion of the agitation shaft 22A protruding through the second cylindrical member 31, a stop ring 22D for slip-off preventing is fitted.

Around the outer circumferential face of the second cylindrical member 31, the agitation gear 35 is formed integrally. The agitation gear 35 is a so-called spur gear, and provided on the same axis as the second cylindrical member 31.

On the left end face (a face facing the first cylindrical member 30) of the second cylindrical member 31, a plurality of second claw parts 36 is provided side by side in the rotational direction. Each second claw part 36 is a projection inclined in one direction of the rotational direction, and has an upright face 36A parallel to the axial direction on one side of the rotational direction and an inclined face 36B crossing to the axial direction on the other side of the rotational direction (refer to FIG. 4). The plurality of second claw parts 36 is so shaped to be complimentary to the plurality of first claw parts 34 and to be engaged with the plurality of first claw parts 34.

(Pressing spring) The pressing spring 32 is a compression spring, and disposed between the right step part 22C of the agitation shaft 22A and the left end face of the first cylindrical member 30. The pressing member 32 has a function to bias the first cylindrical member 30 to the second cylindrical member 31.

<Development device> As shown in FIG. 6, the development device 12 as an attachment unit includes a casing 40 which supports the development roller 12A (not shown in FIG. 6) so as to be rotatable around an axis. On the front portion of the upper face of the casing 40, an attachment part 41 to which the toner container 13 is attached is formed. The attachment part 41 is formed to be recessed downward corresponding to the shape of the lower portion of the toner container 13 (the container main body 20). In the right side portion of the attachment part 41, a replenishment port 42 communicating with the inside of the development device 12 is opened.

At the right end of the front end portion of the attachment part 41 of the development device 12, a rack 43 (a contact body) is provided in an upright posture. A plurality of teeth of the rack 43 faces rearward (to a side of the attachment part 41). The rack 43 is provided so as to be engaged with (come into contact with) the agitation gear 35 on the attachment and detachment process of the toner container 13 to the development device 12 (the attachment part 41).

Figure 7:
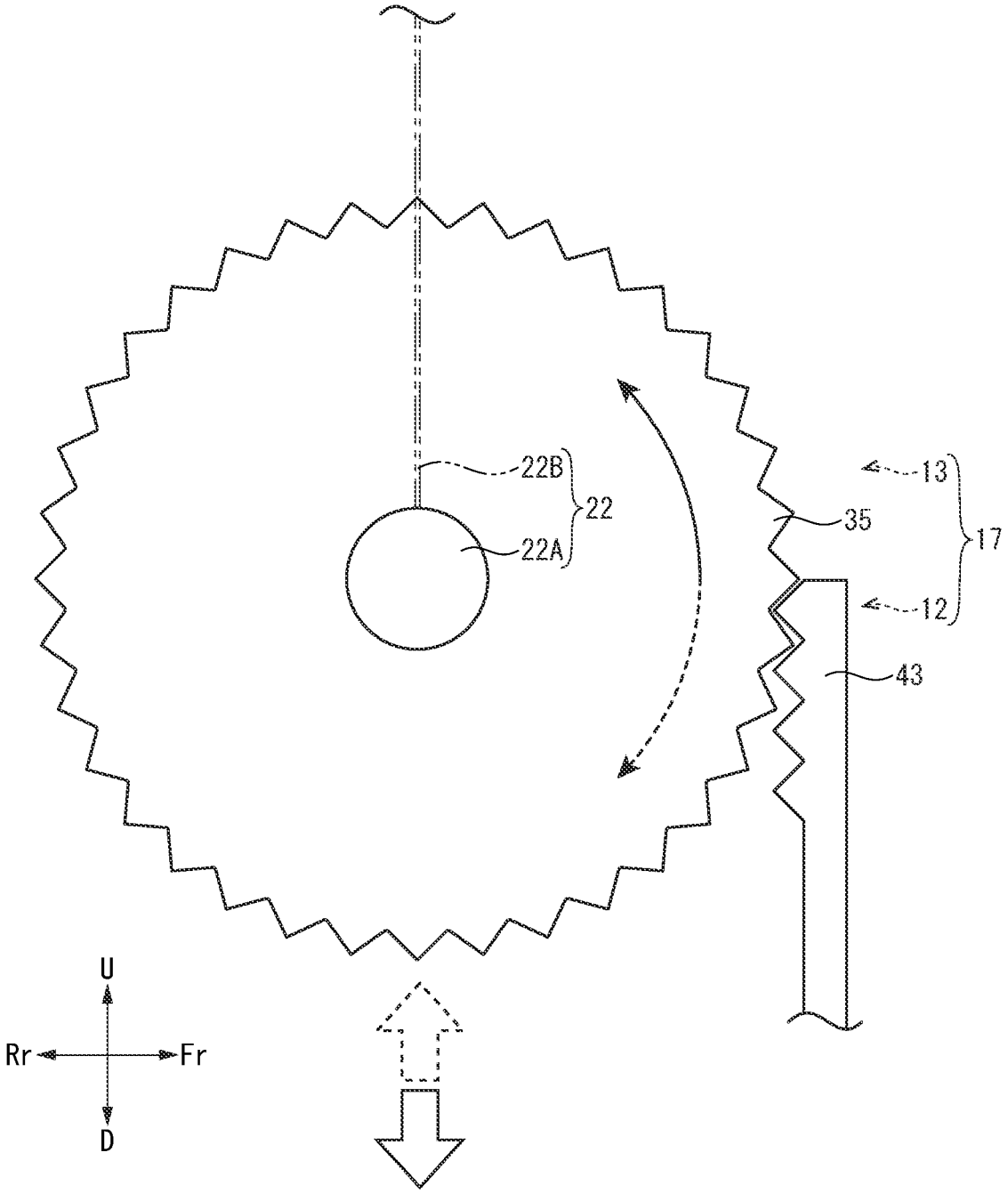
FIG. 7 is a side view explaining an operation of an attachment and detachment structure of the toner container according to the embodiment of the present invention.

[Attachment and detachment of toner container] Next, as shown in FIG. 4 to FIG. 7, an operation of the attachment and detachment structure 17 of the toner container 13, that is, an attachment and detachment of the toner container 13 will be described. FIG. 7 is a side view explaining the operation of the attachment and detachment structure 17 of the toner container 13. In a state before the toner container 13 is attached to the development device 12 (the attachment part 41), the shutter 25 closes the discharge port 24. The state where the toner container 13 is not attached to the attachment part 41 is defined as an initial state.

<Attachment of toner container> The toner container 13 is attached to the attachment part 41 when a new printer 1 is firstly used. Alternatively, the toner container 13 is replaced with a used toner container when it is empty (an amount of the toner remaining in the toner container becomes small). By the way, the toner contained in the container main body 20 of the toner container 13 may be solidified owing to its gravity or vibration at transporting (in detail, the toner is not solidified completely and aggregated to form a block of the toner in many cases). If the toner container 13 containing the solidified toner is attached to the attachment part 41 and then the conveyance screw 21 and the agitation member 22 are driven, the solidified toner obstructs the rotation of the conveyance screw 21 and the others. This increases torque of the conveyance screw 21 and the others abnormally, and it becomes difficult to replenish a predetermined amount of the toner to the development device 12. Then, the attachment and detachment structure 17 of the toner container 13 according to the present embodiment is configured to loosen the toner contained in the container main body 20 during the attachment process of the toner container 13 to the development device 12, that is, before the attachment of the toner container 13 is completed.

Firstly, an operator detaches the exterior cover from the apparatus main body 2 (the discharge tray 4) (refer to FIG. 2) to expose the attachment part 41 of the development device 12. Next, the operator attaches the toner container 13 to the attachment part 41. Specifically, the operator positions the toner container 13 above the attachment part 41, and engages the agitation gear 35 of the toner container 13 with the rack 43 of the attachment part 41. After that, the operator moves the toner container 13 downward (toward the attachment part 41). Then, as shown the solid line arrow in FIG. 7, the agitation gear 35 rolls (rotates) downward while engaging with the rack 43. That is, a force for moving the toner container 13 downward is changed into a force for rotating the agitation gear 35.

The ratchet mechanism 23 connects the agitation gear 35 to the agitation member 22 on the attachment process of the toner container 13 to the attachment part 41 of the development device 12. Specifically, as shown in FIG. 4, each first claw part 34 of the first cylindrical member 30 is pressed by the pressing spring 32 to be engaged with each second claw part 36 of the second cylindrical member 31. The upright face 34A of each first claw part 34 is caught by the upright face 36A of each second claw part 36, and the first cylindrical member 30 and the second cylindrical member 31 are thus rotated together. The agitation shaft 22A is engaged with the first cylindrical member 30 via the key 33B and the others, and rotated together with the first cylindrical member 30. As described above, a rotational force of the agitation gear 35 is transmitted to the agitation member 22 via the second cylindrical member 31 and the first cylindrical member 30, and the agitation member 22 is thus rotated around the axis. Because the agitation gear 35 is separated away from the coupling transmission mechanism and disconnected from the driving gear 26, the conveyance screw 21 is not rotated.

As described above, on the attachment process of the toner container 13 to the development device 12, the agitation member 22 is rotated to loosen the toner solidified in the container main body 20.

When the toner container 13 is placed (attached) to the attachment part 41, the driving gear 26 is coupled with a driving source M via a driving force transmission mechanism containing a gear train and the others (not shown). In the state where the toner container 13 is attached to the attachment part 41, the agitation gear 35 is separated away from the rack 43 and coupled with the driving gear 26 via a coupling transmission mechanism containing a gear train and the others (not shown). That is, the agitation gear 35 is indirectly coupled with the driving source M. Furthermore, the shutter 25 of the toner container 13 faces the replenishment port 42 of the attachment part 41. Next, the operator operates the lever to open the shutter 25 to communicate the discharge port 24 with the replenishment port 42.

In the above described manner, the attachment of the toner container 13 to the attachment part 41 of the development device 12 is completed. In this state, the toner contained in the container main body 20 is loosened so that it becomes possible to replenish the toner from the toner container 13 to the development device 12 smoothly.

<Detachment of the toner container> Next, a case where the toner container 13 is detached (separated) from the development device 12, such as a case where the empty toner container 13 in which the toner is consumed is replaced, will be described.

Firstly, the operator detaches the exterior cover from the apparatus main body 2 to expose the toner container 13 attached to the attachment part 41 of the development device 12. Next, the operator operates the lever so as to close the discharge port 24 by the shutter 25. After that, when the operator pulls up the toner container 13, the driving gear 26 is separated away from the driving force transmission mechanism, the agitation gear 35 is separated away from the coupling transmission mechanism and then engaged with the rack 43. When the operator further pulls up the toner container 13, as shown by the dotted line arrow in FIG. 7, the agitation gear 35 rolls (rotate) upward while engaging with the rack 43. That is, a force for moving the toner container 13 upward is changed into a force for rotating the agitation gear 35.

The ratchet mechanism 23 separates the agitation gear 35 from the agitation member 22 on the detachment process of the toner container 13 from the attachment part 41 of the development device 12. Specifically, when the agitation gear 35 is rotated in an opposite direction to the rotational direction at the attachment process, each second claw part 36 of the second cylindrical member 31 is slid on the inclined face 34B of each first claw part 34 while pushing the first cylindrical member 30 against the biasing force of the pressing spring 32 (refer to FIG. 4). When the second claw part 36 runs on the first claw part 34 and is separated away from the inclined face 34B, the first cylindrical member 30 is biased by the pressing spring 32 and returned to the original position, and the second claw part 36 is engaged with the adjacent first claw part 34. Accordingly, a rotational force of the agitation gear 35 and the second cylindrical member 31 is not transmitted to the first cylindrical member 30, and the agitation member is not rotated. Because the agitation gear 35 is separated away from the coupling transmission mechanism and disconnected from the driving gear 26, the conveyance screw 21 is not rotated.

When the toner container 13 is drawn out from the attachment part 41 completely, the agitation gear 35 is separated away from the rack 43. In the above described manner, the detachment of the toner container 13 from the attachment part 41 of the development device 12 is completed.

The attachment and detachment structure 17 of the toner container 13 according to the above described present embodiment is configured such that the agitation gear 35 is rotated around the axis while engaging with the rack 43 (while the driving force transmission body coming into contact with the contact body) on the attachment process of the toner container 13 to the development device 12. According to the configuration, it becomes possible to rotate the agitation member 22 connected to the agitation gear 35 as the toner container 13 is attached. Thereby, it becomes possible to loosen the solidified toner before the attachment of the toner container 13 to the development device 12 is completed.

According to the attachment and detachment structure 17 of the toner container 13 according to the present embodiment, because the ratchet mechanism 23 connects the agitation gear 35 to the agitation member 22 only at the attachment of the toner container 13, it becomes possible to rotate the agitation member 22 and to loosen the toner as the toner container 13 is attached.

Furthermore, because the ratchet mechanism 23 separates the agitation gear 35 away from the agitation member 22 at the detachment of the toner container 13, the rotational torque of the agitation member 22 is not transmitted to the agitation gear 35 at the detachment of the toner container 13. Then, the operator can detach the toner container 13 smoothly with small force (improvement of workability).

The attachment and detachment structure 17 of the toner container 13 according to the present embodiment is configured such that the agitation gear 35 has a function to be indirectly connected to the driving gear 26 after the attachment of the toner container 13 and also a function to be engaged with the rack 43 on the attachment process of the toner container 13. In the above manner, the agitation gear 35 is used for the two purposes. Thereby, because it is not required to provide the gear to be engaged with the driving gear 26 separately from the agitation gear 35 to be engaged with the rack 43, it becomes possible to make the attachment and detachment structure 17 simple and to reduce the manufacturing cost.

According to the attachment and detachment structure 17 of the toner container 13 according to the present embodiment, using the agitation gear 35 and the rack 43 makes it possible to change the movement of the toner container 13 along the attachment and detachment direction (the upper-and-lower direction) into the rotational movement of the agitation gear 35 (the rotational member) effectively.

Figure 8:
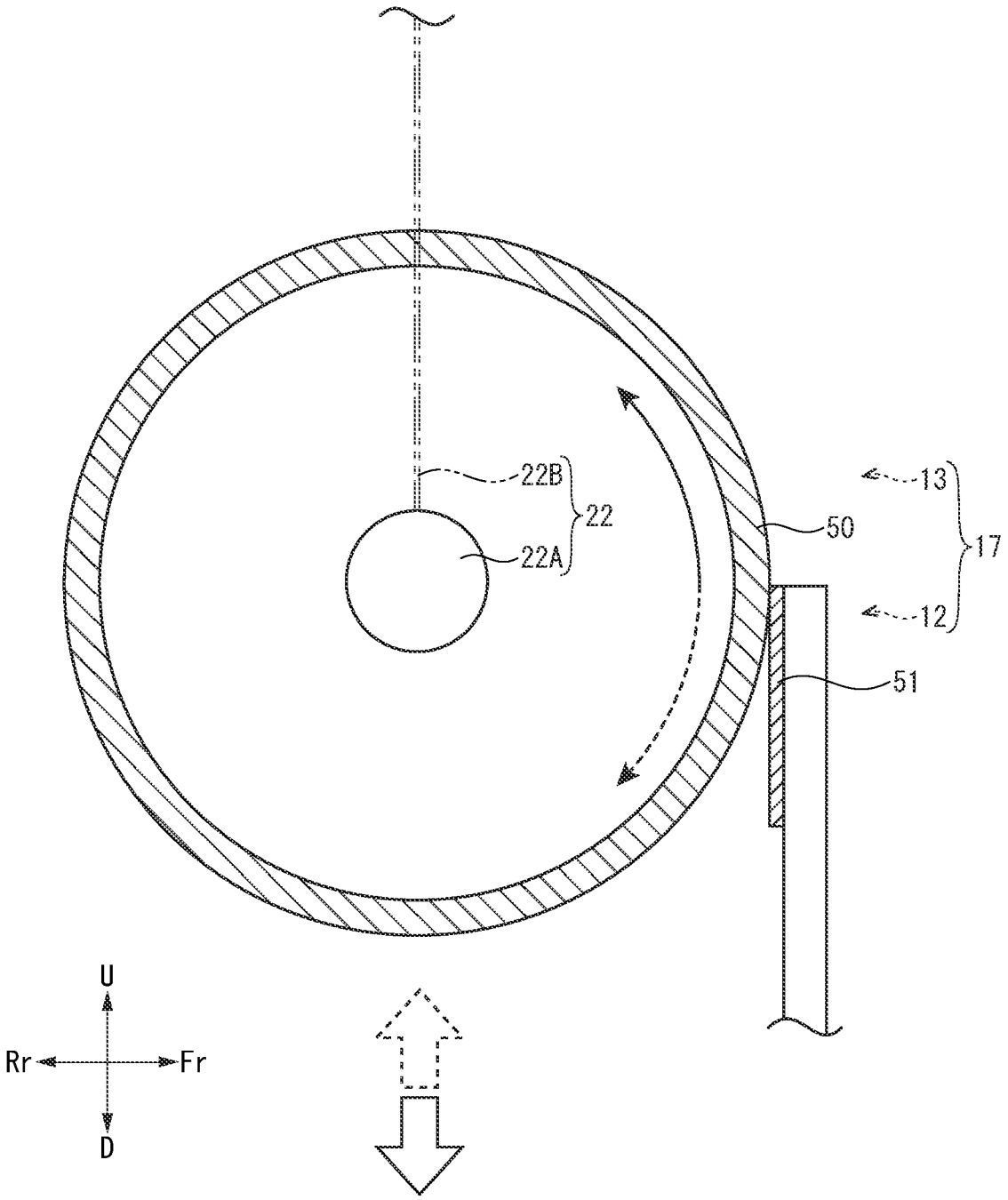
FIG. 8 is a side view explaining an operation of the attachment and detachment structure 17 of the toner container according to a modified example of the embodiment of the present invention.

The above described attachment and detachment structure 17 of the toner container 13 according to the present embodiment employs the agitation gear 35 as a driving force transmission body and the rack 43 as an example of the contact body, but the present disclosure is not limited thereto. As shown in FIG. 8, for example, in the attachment and detachment structure 17 according to a modified example, a roller 50 rotating around an axis may be employed as another example of the driving force transmission body and a frictional plate 51 which is pressed on the roller 50 may be employed as another example of the contact body. Preferably, the roller 50 may be a rubber roller formed by layering elastic material layers, such as a rubber layer, around the rotational shaft. The frictional plate 51 is preferably made of synthetic resin or metal, for example, and suitably selected depending on friction with the roller 50 (the rubber roller). The roller 50 may be provided in place of the agitation gear 35 or may be added in addition to the agitation gear 35 for transmitting the driving force. In the configuration of the modified example, the same operation and effect as the attachment and detachment structure 17 of the toner container 13 according to the above described present embodiment can be obtained.

In the attachment and detachment structure 17 of the toner container 13 according to the present embodiment (containing the modified example, hereinafter the same), the ratchet mechanism 23 is provided such that the agitation gear 35 and the roller 50 (hereinafter, called the agitation gear 35 and the others) are connected to the agitation member 22 only at the attachment of the toner container 13, but the present disclosure is not limited thereto. For example, the ratchet mechanism 23 may be omitted (not provided) (the example is not shown). In this case, the agitation gear 35 and the others are rotated around the axes while coming into contact with the rack 43 or the frictional plate 51 (hereinafter, called the rack 43 and the others) on the attachment and detachment process (both the attachment process and the detachment process) of the toner container 13 to the development device 12.

In the attachment and detachment structure 17 of the toner container 13 according to the present embodiment, the agitation gear 35 and the others are indirectly coupled with the driving source M via the coupling transmission mechanism and the driving gear 26, but the present disclosure is not limited thereto. The agitation gear 35 and the others may be directly coupled with the driving source M (the example is not shown).

In the attachment and detachment structure 17 of the toner container 13 according to the present embodiment, the development device 12 is shown as an example of the attachment unit, but the present disclosure is not limited thereto. A special attachment unit for attaching the toner container 13 may be provided between the toner container 13 and the development device 12 (the example is not shown).

In the attachment and detachment structure 17 of the toner container 13 according to the present embodiment, the agitation member 22 is shown as an example of the rotational member, but the present disclosure is not limited thereto. For example, as another example of the rotational member, the conveyance screw 21 may be employed, and as another example of the power transmission body, the driving gear 26 may be employed. That is, the driving gear 26 may be rotated while engaging with the rack 43 to rotate the conveyance screw 21. In this case, the ratchet mechanism 23 may be preferably provided between the conveyance screw 21 and the driving gear 26 (the example is not shown). Furthermore, one of the driving gear 26, and the agitation gear 35 and the others may come into contact with the rack 43 and the others, and both the agitation member 22 and the conveyance screw 21 may be rotated (the example is not shown).

It should be noted that the description of the above embodiment shows one aspect of the attachment and detachment structure of the toner container and the image forming apparatus according to the present disclosure, and the technical scope of the present disclosure is not limited to the above embodiments.

The invention claimed is:

1. An attachment and detachment structure of a toner container to and from an attachment unit, wherein the toner container includes:

a container main body containing a toner;

a rotational member rotating around an axis to agitate the toner contained in the container main body; and a power transmission body provided outside the container main body and rotating around an axis to transmit a rotational force to the rotational member, the attachment unit includes a contact body which comes into contact with the power transmission body on attachment process and detachment process of the toner container to and from the attachment unit and rotates the power transmission body, and the power transmission body comes into contact with the contact body on the attachment process of the toner container to the attachment unit, and is rotated around the axis to rotate the rotational member around the axis.

2. The attachment and detachment structure of the toner container to and from the attachment unit according to claim 1, wherein the toner container further includes a coupling part provided between the rotational member and the power transmission body, and the coupling part transmits the rotational force of the power transmission body to the rotational member on the attachment process of the toner container to the attachment unit, and does not transmit the rotational force of the power transmission body to the rotational member on the detachment process of the toner container from the attachment unit.

3. The attachment and detachment structure of the toner container to and from the attachment unit according to claim 2, wherein the coupling part is a ratchet mechanism to rotate the rotational member only in one direction.

4. The attachment and detachment structure of the toner container to and from the attachment unit according to claim 1, wherein the power transmission body is separated away from the contact body in a state where the toner container is attached to the attachment unit, and coupled with a driving source for driving the rotational member.

5. The attachment and detachment structure of the toner container to and from the attachment unit according to claim 1, wherein the contact body has a predetermined length along an attachment and detachment direction of the toner container.

6. The attachment and detachment structure of the toner container to and from the attachment unit according to claim 1, wherein the power transmission body is a gear, and the contact body is a rack engaged with the gear.

7. The attachment and detachment structure of the toner container to and from the attachment unit according to claim 1, wherein the power transmission body is a roller, and the contact body is a frictional plate which is pressed on the roller.

8. An image forming apparatus comprising:

the attachment and detachment structure of the toner container to and from the attachment unit according to claim 1, and an image forming part which forms an image using the toner contained in the toner container.

* * * * *